US006580085B1

(12) United States Patent
Gaucherand

(10) Patent No.: US 6,580,085 B1
(45) Date of Patent: Jun. 17, 2003

(54) TRANSPORT CONTAINER FOR NUCLEAR FUEL ASSEMBLIES

(75) Inventor: Bernard Gaucherand, Lyons (FR)

(73) Assignee: Framatome, Courbevoie (FR)

( * ) Notice: Subject to any disclaimer, the term of this patent is extended or adjusted under 35 U.S.C. 154(b) by 0 days.

(21) Appl. No.: 09/601,960

(22) PCT Filed: Feb. 2, 1999

(86) PCT No.: PCT/FR99/00218

§ 371 (c)(1),
(2), (4) Date: Sep. 25, 2000

(87) PCT Pub. No.: WO99/41754

PCT Pub. Date: Aug. 19, 1999

(30) Foreign Application Priority Data

Feb. 10, 1998 (FR) ..... 98 01553

(51) Int. Cl.[7] ..... G21F 5/00; G21C 19/00

(52) U.S. Cl. ..... 250/507.1; 376/272

(58) Field of Search ..... 250/506.1, 507.1; 376/261, 272

(56) References Cited

U.S. PATENT DOCUMENTS

| | | | | |
|---|---|---|---|---|
| 3,575,601 A | | 4/1971 | Lindsay et al. | |
| 3,886,368 A | * | 5/1975 | Rollins et al. | 250/507.1 |
| 4,780,268 A | * | 10/1988 | Papai et al. | 376/272 |
| 5,263,063 A | * | 11/1993 | Sappey | 376/261 |
| 5,263,064 A | * | 11/1993 | Sappey | 376/261 |
| 5,481,117 A | * | 1/1996 | Gilmore et al. | 250/507.1 |
| 5,490,186 A | * | 2/1996 | Gilmore et al. | 376/272 |

FOREIGN PATENT DOCUMENTS

| | | | |
|---|---|---|---|
| DE | 29 42 092 | | 4/1981 |
| DE | 36 10 862 | | 10/1987 |
| EP | 0 078 107 | | 5/1983 |
| EP | 0 128 236 | | 12/1984 |
| EP | 0 506 512 | | 3/1992 |
| GB | 2055671 | * | 3/1981 |
| JP | 2000131491 A | * | 5/2000 |

* cited by examiner

*Primary Examiner*—Bruce Anderson
(74) *Attorney, Agent, or Firm*—Kenyon & Kenyon

(57) ABSTRACT

A transport container for nuclear fuel assemblies, of right prismatic shape, which has an external envelope and an internal structure defining at least one housing for receiving and holding a fuel assembly.

8 Claims, 8 Drawing Sheets

TRANSPORT CONTAINER FOR NUCLEAR FUEL ASSEMBLIES

FIELD OF THE INVENTION

The invention relates to a transport container for nuclear fuel assemblies and in particular to a transport container for new fuel assemblies intended for refuelling a pressurized water nuclear reactor.

BACKGROUND INFORMATION

Nuclear reactors such as pressurized water nuclear reactors have a core made up of nuclear fuel assemblies which are of right prismatic shape and generally slim with a square cross section. The fuel assemblies generally have a cross section having the shape of a square, the side of which has a length close to 20 cm, the length of the fuel assembly, in its longitudinal direction, being about 4 meters. The fuel assemblies have a framework inside which nuclear fuel rods are arranged, essentially along the entire length of the fuel assembly. The framework itself is made up of spacer-grids which transversely hold the rods distributed over the length of the fuel assembly, of guide-tubes parallel to the rods engaged in the spacer-grids and of fuel assembly end nozzles.

Prior to reactor startup, the core needs to be fuelled with new fuel assemblies. Some core assemblies also need to be replaced after a certain period of time. New fuel assemblies need to be loaded into the core or substituted for used fuel assemblies which are removed from the core of the nuclear reactor. It is therefore necessary to have available new fuel assemblies which must be transported from the fuel fabrication plant to the nuclear power station in which the core of a nuclear reactor is being fuelled or refuelled.

The transport of new fuel assemblies, which is carried out by rail or by road, requires the use of transport containers which ensure effective protection of the fuel assemblies whose rods are not protected laterally between two successive spacer-grids. The transport containers must also be designed to avoid the destruction or even limited deterioration of the fuel assemblies, should the container be dropped, for example during a container transhipment manoeuvre during transport.

Fuel assembly transport containers are known from EP A, 506,512 and U.S. Pat. No. 5,481,117 which comprise an external envelope made from sheet metal made in the shape of two almost semi-cylindrical half-shells brought together and fixed one on top of the other along a rectangular frame arranged in an axial plane in the diametral direction of the container. The container is generally designed for the transport of two fuel assemblies and has a frame on which two fuel assemblies can be fixed, which rests on a cradle fixed via shock-absorber support elements inside the lower half-shell of the external envelope of the container. The frame for supporting and holding fuel assemblies is mounted such that it pivots on the cradle, by one of its ends, so that it can be moved between a position for loading fuel assemblies, in which position the support is substantially vertical, and a transport position in which the frame for supporting fuel assemblies rests on the cradle in a substantially horizontal position.

The frame for supporting fuel assemblies generally has a T-shaped transverse cross section which has a base for supporting fuel assemblies and a median wall in the longitudinal direction perpendicular to the base. The base supporting the fuel assemblies and the median wall define, on either side of the median wall, two housings into each one of which a fuel assembly can be placed. The fuel assemblies are held in the frame, via flanges articulated on the lateral edges of the base and on the upper edge of the median wall of the frame, so that the flanges can be moved between an open position in which the fuel assembly housing is accessible and a closed position in which the flanges hold the fuel assembly. The flanges are assembled to one another, in their closed position, by screw and nut assemblies and are arranged over the length of the frame so as to rest against the fuel assemblies placed in the housings of the frame, at each successive spacer-grid of the fuel assemblies.

The transport containers are designed so that the fuel assemblies placed side by side in the transport position cannot at any time form a critical mass leading to the initiation of neutron chain reactions. It is generally necessary to place neutron-absorbing elements between the fuel assemblies in the transport position inside the container, in order to avoid any risk of criticality.

Furthermore, it is also necessary to limit as much as possible the risks of the spreading of the fissile material contained in the fuel assemblies, should the fuel assembly undergo deterioration or destruction leading to the rupture of the protective cladding of the fuel rods, for example as a consequence of dropping the container.

In the case of transport containers of the known art, it is known that neutron-absorbing insulation means for fuel assemblies could be inadequate and that the containers do not have a structure enabling effective containment of the fissile material should the fuel assembly deteriorate inside the container. This is because the fuel assembly is neither protected nor contained inside the external envelope of the container, the frame only having means of holding fuel assemblies, in the form of flanges spaced over the longitudinal direction of the fuel assemblies, in the same way as the spacer-grids.

Furthermore, simulations of the dynamic behaviour of the containers and fuel assemblies, should the fuel assembly container be dropped in the axial direction or should it be dropped flat, have made it possible to show that highly effective energy absorbers need to be available to guarantee the mechanical integrity of the frame and of the fuel assemblies contained in the container envelope, should this container be dropped.

It therefore appears desirable to have available transport containers which ensure improved protection for fuel assemblies.

SUMMARY

The object of the invention is therefore to provide a transport container for nuclear fuel assemblies of right prismatic shape, which has an external envelope and an internal structure defining at least one housing for receiving and holding a fuel assembly, having lateral faces arranged over a right prismatic surface and an end face at each longitudinal end of the housing, this transport container providing effective protection for the transported fuel assembly or assemblies and containing the fissile material contained in the fuel assemblies in order to prevent the fissile material spreading inside the external envelope of the container should the fuel assemblies deteriorate or be destroyed.

For this purpose, the internal structure of the container has a reception and holding unit for at least one fuel assembly having a support frame for at least one fuel assembly comprising at least two support walls for two lateral faces of a fuel assembly and two pivoting end walls for holding the longitudinal end parts of the fuel assembly as well as at least one door mounted such that it pivots on the frame between an open position to give access to the fuel assembly housing and a closed position in which the door, with the end walls and the bearing walls of the frame, ensures complete closure of a fuel assembly housing and protection and containment of the fuel assembly, independently of the external envelope.

The internal structure constitutes a case for receiving at least one fuel assembly, which case may be opened to give access to the fuel assembly housing.

BRIEF DESCRIPTION OF THE DRAWINGS

In order to make the invention easy to understand, a transport container for new fuel assemblies for a pressurized water nuclear reactor, according to the invention, will be described with reference to the appended figures.

DETAILED DESCRIPTION

Figure 1:
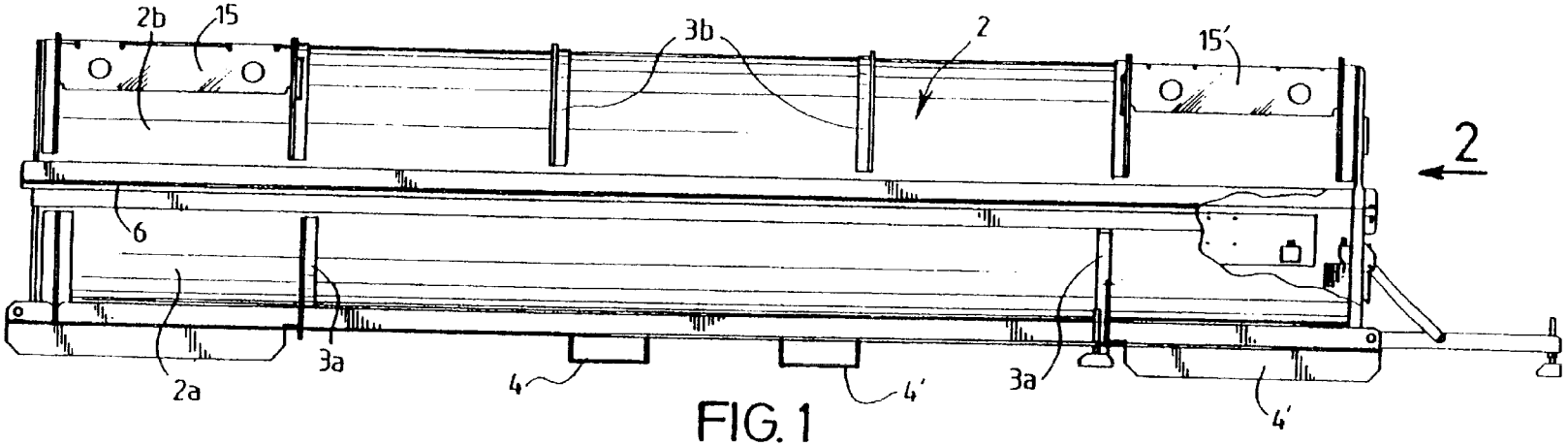
FIG. 1 is a side elevation view of the container in a configuration which is closed for transport.
Figure 2:
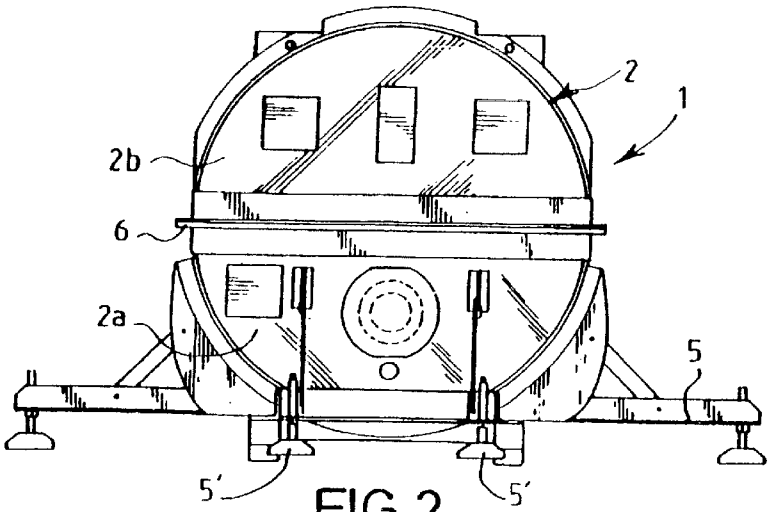
FIG. 2 is an end view along 2 of FIG. 1.

FIGS. 1 and 2 show a transport container for new fuel assemblies of a pressurized water nuclear reactor denoted overall by the reference number 1.

The transport container 1, which is designed to transport two fuel assemblies in a horizontal position, has an external envelope 2 formed by a lower shell 2*a* and an upper shell 2*b*, both semi-cylindrical in shape and connected one on top of the other along a joining plane of the envelope 2 passing through the longitudinal axis of the cylindrical-shaped envelope.

Each of the shells 2*a* and 2*b* is made from steel sheet and has semicircular reinforcing ribs 3*a*, 3*b* respectively, distributed over the length of the half-shell.

Sections 4 and 4' are also fixed to the lower part of the lower half-shell 2*a*, said sections forming support feet for the container. Furthermore, adjustable support elements 5 and 5', which have screw jacks and which are secured to a longitudinal end part of the container, enable the inclination of the container resting on a support surface to be adjusted about the longitudinal axis of the container and about a transverse axis of the container respectively. By using the adjustable feet 5 and 5' of the container, it is possible to place the container, on its transport support, in a perfectly horizontal position, i.e. in a position in which the longitudinal axis of the container is perfectly horizontal.

The two half-shells 2*a* and 2*b* are brought together one on top of the other via rectangular peripheral flanges forming an upper planar support part of the lower half-shell 2*a* and a lower planar support part of the upper half-shell 2*b* of the container.

In the closed position of the container, shown in FIGS. 1 and 2, the flanges of the two half-shells 2*a* and 2*b* are brought together and fixed one on top of the other by screws and nuts, forming an assembly flange 6.

Figure 3A:
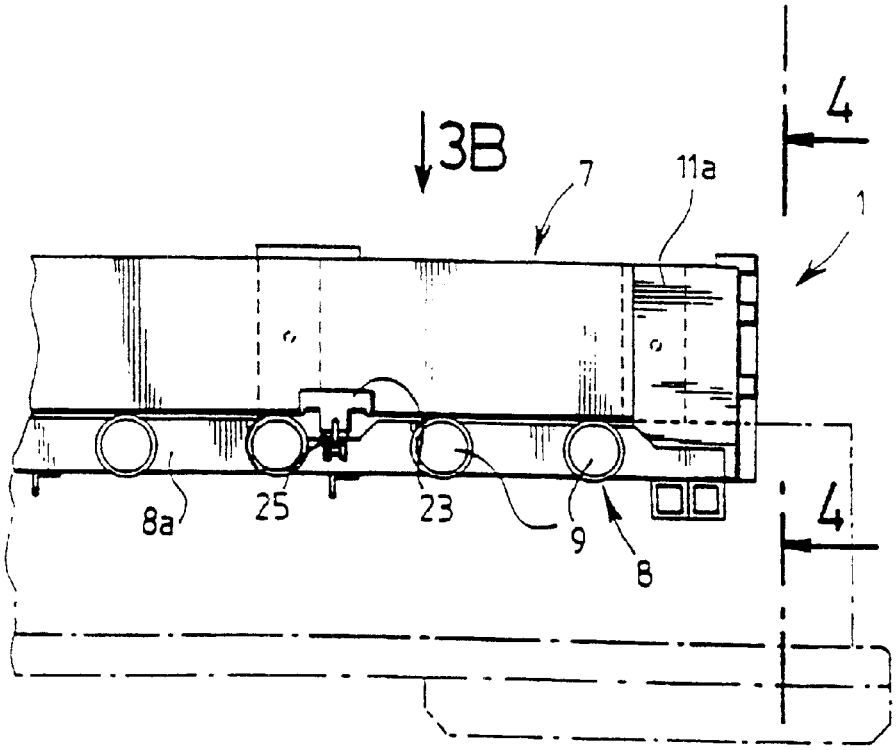
FIG. 3A is a partial view in elevation of the container of which the upper shell of the external envelope is removed, in order to show the internal structure of the container.
Figure 3B:
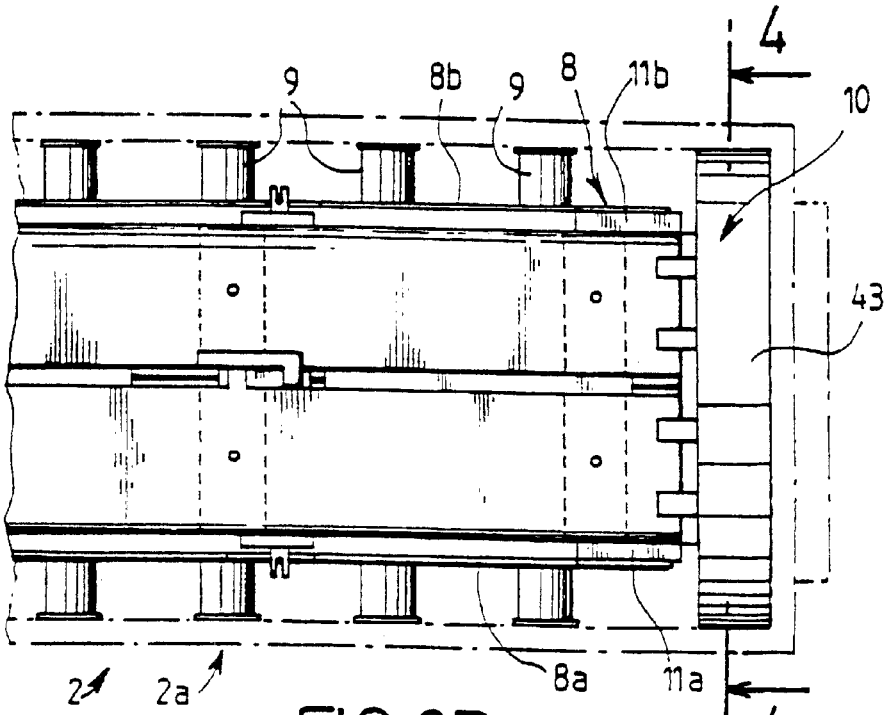
FIG. 3B is a top view of the open container along 3B of FIG. 3A.

FIGS. 3A and 3B show a part of the container in the open state, i.e. with the upper half-shell of the container envelope separated from the lower half-shell and removed.

FIGS. 3A and 3B show the internal structure of the container, denoted overall by the reference number 7, which has in particular a cradle 8 resting on supports 9 formed by shock-absorber pads, in the lower half-shell 2*a* of the external envelope 2 of the container. A second part of the internal structure of the container is formed by a unit 10 for receiving and supporting two fuel assemblies in the horizontal position placed side by side. The unit 10, which rests on the cradle 8, defines two completely closed housings for two fuel assemblies, as will be explained hereinafter.

The cradle 8 has two side rails 8*a*, 8*b* formed by angle brackets fixed on the support pads 9 and which are held in parallel positions, with a separation corresponding to the width of the unit 10 for receiving the container, by crossmembers. At one of its ends, the cradle has a pivoting stiffening and mounting unit comprising two plates 11*a* and 11*b* which are parallel to one another and two crossmembers formed by hollow sections fixed to the side rails of the cradle and to the plates 11*a* and 11*b*.

The mounting of the cradle on the lower shelf of the container such that it can pivot about a horizontal axis of transverse direction, is ensured via the pivoting stiffening and mounting unit comprising the plates 11*a* and 11*b*.

Furthermore, as will be explained hereinafter, a retaining plate for fuel assemblies is also mounted between the plates 11*a* and 11*b*.

As can be seen in FIG. 3B, a shock absorber 43 is inserted between the longitudinal end of the internal structure 7 and the internal circular end wall of the external envelope 2, in such a way as to limit the effect of a shock to the fuel assemblies, for example the effect of dropping a container. The shock-absorber 43, in the shape of a disc whose cross section is identical to the internal cross section of the container envelope, is made up of a balsa disc surrounded by an envelope made from stainless steel sheet. Of course, an identical shock absorber is positioned at the second longitudinal end of the container, between the second longitudinal end of the internal structure and the second end of the external envelope.

Figure 4:
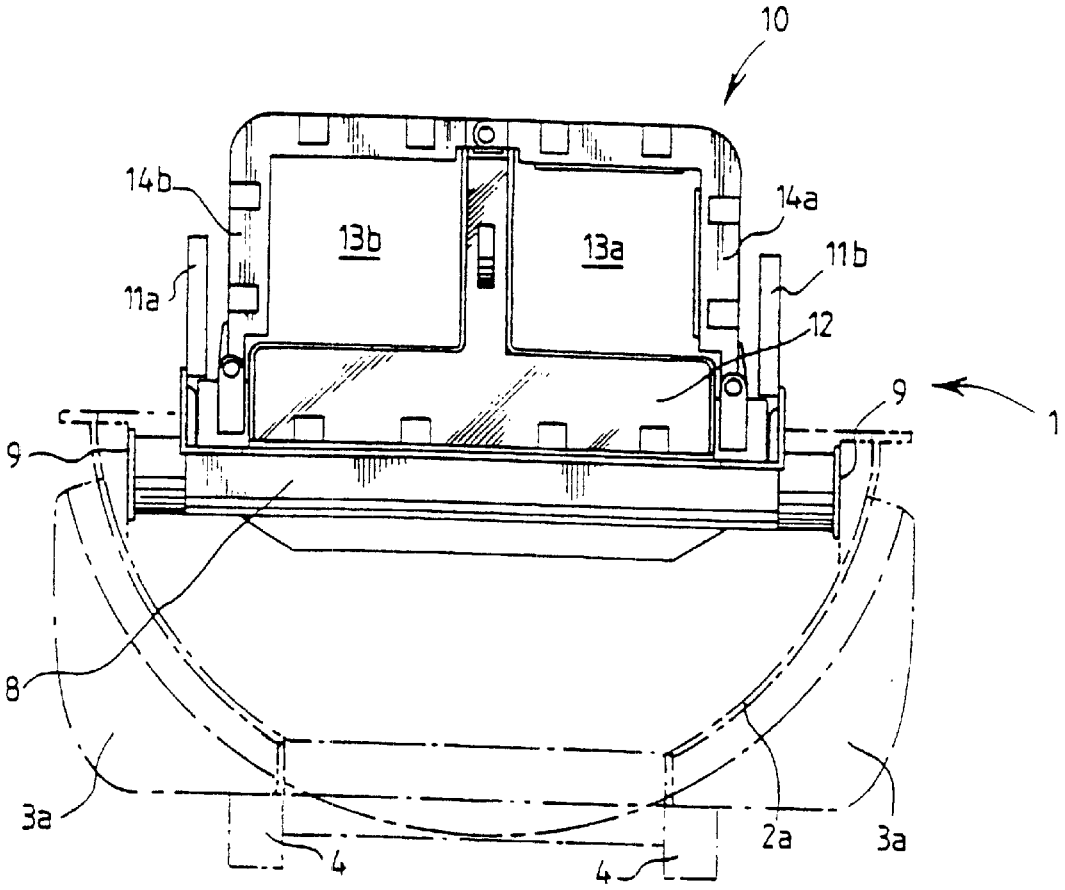
FIG. 4 is an end view along 4—4 of FIG. 3A or of FIG. 3B.

As can be seen in FIG. 4, the fuel assembly support and reception unit 10 has a frame 12 having a Tshaped cross section and two doors 14*a* and 14*b* mounted is such that they pivot on the sides of the frame 12, as will be explained hereinafter.

In the closed position of the doors, as shown in FIG. 4, the door 14*a* together with the right part of the frame 12 defines a housing 13*a* for one fuel assembly and the door 14*b* together with the left part of the frame 12 defines a second housing 13*b*. The housings have a square cross section which has the dimensions of the cross section of a spacer-grid of a pressurized water nuclear reactor fuel assembly for which the container 1 ensures transport.

To load the container, the cradle 8 is made to tilt about the transverse axis located at one of the ends of the cradle into a position which is substantially vertical.

In its tilted position, the fuel assembly reception and support unit 10, is in a vertical position. The doors 14*a* and 14*b* are tilted towards the outside, in such a way as to give access to the housings 13*a* and 13*b*.

A fuel assembly may be placed in each of the housings 13*a* and 13*b*, using a fuel assembly lifting tool, for example the hoist of an overhead crane. The fuel assemblies come to rest, via their bottom nozzles, on the fuel assembly support plate fixed between the two plates 11*a* and 11*b* of the cradle 8.

The doors of the fuel-assembly reception and support unit 10 are closed and the unit 10 is tilted into the horizontal position, coming to rest on the cradle 8.

After having placed the upper half-shell back on the lower half-shell of the envelope 2 and fixed the two half-shells by screws and nuts, the container can be handled and transported, for example by lifting the container using lifting lugs 15 and 15' fixed on the upper half-shell of the external envelope, as shown in FIG. 1.

Figure 5:
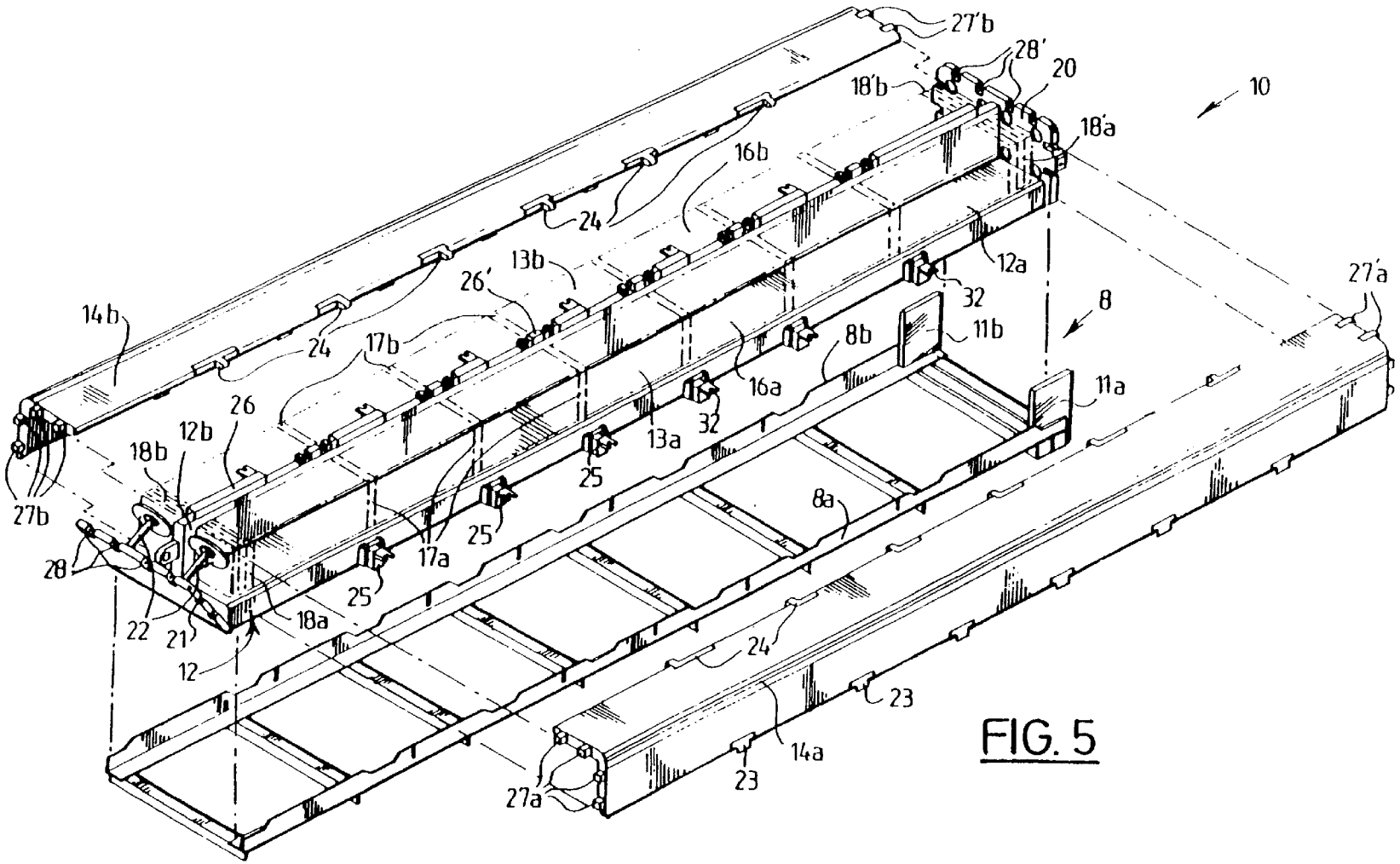
FIG. 5 is an exploded view in perspective of the elements forming the internal structure of the fuel assembly transport container.

FIG. 5 shows an exploded view in perspective of the cradle 8 and the various elements forming the fuel assembly reception and support unit 10.

The frame 12, which has a T-shaped transverse section, has a parallelepipedal base 12*a* and a wall 12*b* perpendicular to the base 12*a*, separating the housings 13*a* and 13*b* for two fuel assemblies 16*a* and 16*b*, the spacer-grids 17*a* and 17*b*, the bottom nozzles 18*a* and 18*b* and the top nozzles 18'*a* and 18'*b* of which are shown.

The housings 13*a* and 13*b* of the fuel assemblies 16*a* and 16*b* are defined at one of the ends of the frame 12, by a support plate 20 intended to be fixed such that it pivots, via stub shafts, between the plates 11*a* and 11*b* of the cradle 8 and a second end plate 21 mounted such that it pivots at the second end of the frame 12, about a transverse pivot axis. The fuel assemblies rest, via their top nozzles 18'*a* and 18'*b*, on the plate 20. The transverse holding plate 21 has adjustable supporting end-stops on the bottom nozzles 18*a* and 18*b* of the fuel assemblies. The plate 21 could also have adjustable means for holding the fuel assemblies in the longitudinal direction.

When the end plates 20 and 21 are pulled down into their closed position, the fuel assemblies are held in the longitudinal direction by being clamped between the support devices 22 and the plate 20.

The pivoting lateral doors 14*a* and 14*b* of the unit 10 holding and supporting the fuel assemblies 16*a* and 16*b* have an inverted L-shaped cross section and have, along their lower edge, at the end of one of the branches of the L, articulating parts 23 in the form of hinges spaced out over the length of the doors 14*a* and 14*b*.

The doors shown in FIG. 5 have six hinges. 23 spaced apart over the length of a first lower edge of the doors 14*a* or 14*b*.

Along its opposite second edge, at the end of the second branch of the L, each of the doors 14*a* and 14*b* has fixing lugs 24 having a part pierced by an opening and projecting slightly towards the outside with respect to the edge of the door.

The hinge shaped articulating parts 23 have all openings aligned in a direction parallel to the edge of the door and each one engages on an articulation axis 25, fixed so that it projects from a lateral edge of the base 12*a* of the frame 12 of the fuel-assembly support. Similarly, the openings in the parts projecting from the lugs 24 located along the second edge of the doors are aligned in a direction parallel to the edge of the door.

The median wall 12*b* of the frame 12 has on its upper edge guide parts 26 and 26' having openings which are all aligned in a direction parallel to the upper edge of the median wall 12*b* of the frame 12.

When the doors, which are mounted articulated on the articulation axes 25 via hinges 23, are pulled down to the closed position, the second edges of the doors 14*a* and 14*b* along which the lugs 24 are located, are pulled down onto the upper edge of the median wall 12*b* of the frame 12, each of the lugs 24 coming to a position inserted between two successive guide posts 26 and 26' fixed on the upper edge of the median wall 12*b* of the frame 12. The doors 14*a* and 14*b*, when in the closed position, can be locked by introducing a rod into the aligned openings of the parts 26 and 26' and of the lugs 24.

Furthermore, the doors 14*a* and 14*b* have pegs 27*a*, 27'*a* and 27*b*, 27'*b* respectively at their longitudinal ends projecting towards the outside in the longitudinal direction.

The end plates 20 and 21 of the frame 12 each have, along their upper and lateral edges, slots 28 and 28', each one intended to receive one of the pegs 27*a* or 27*b* or one of the pegs 27'*a* and 27'*b* respectively, in the closed position of the doors, after the end walls 20 and 21 have been pulled down.

Furthermore the walls 20 and 21 have openings passing through them, facing each of the nozzles of the fuel assemblies, in their transport position inside the housings 13*a* and 13*b*.

Each of the fuel assembly housings 13*a* or 13*b*, which is defined on two lateral faces by two mutually perpendicular surfaces of the frame 12, on its opposite lateral faces by two internal perpendicular surfaces of a door 14*a* or 14*b* and at its ends by the plates 20 and 21, is completely closed and ensures effective containment of a fuel assembly. Should the container be subjected to a shock, leading to a partial destruction of the fuel assembly, pieces of fuel assemblies, for example pieces of fuel pellets or rods, cannot escape from the fuel assembly housing and be spread in the container.

The doors 14*a* and 14*b* and the end walls 20 and 21 which are mounted such that they pivot, form a box having two housings for fuel assemblies, which can be opened to give access to the fuel assembly housings.

Furthermore, as will be explained hereinafter, the base 12*a* and the median wall 12*b* of the frame and the walls of the doors 14*a* and 14*b* are constructed in the form of a double wall inside the thickness of which a neutron-absorbing resin i.e. a synthetic resin to which is added an element which strongly absorbs neutrons, is placed.

Figure 6:
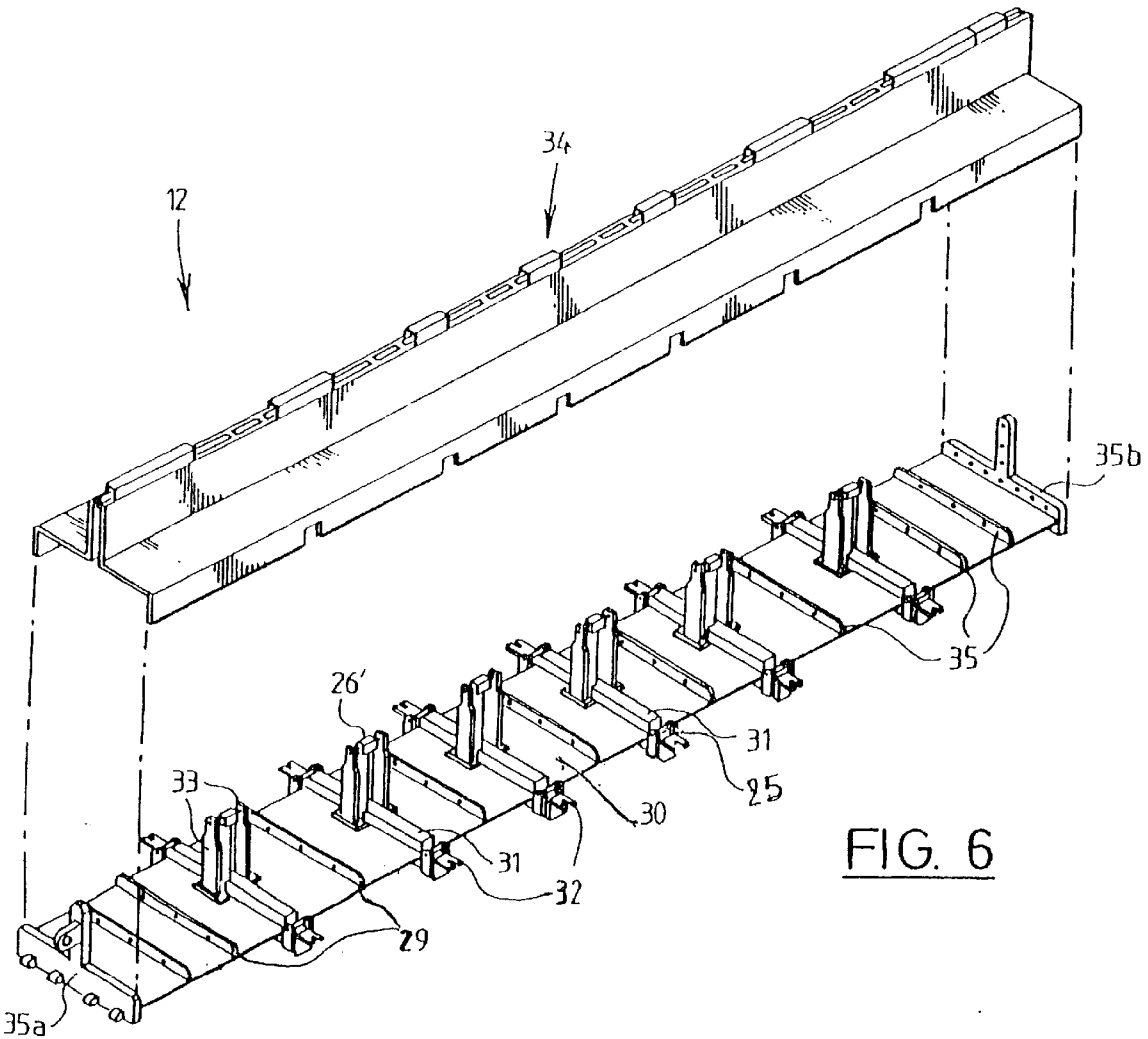
FIG. 6 is an exploded view in perspective of the elements forming the fuel assembly support frame of the internal structure of the container.

FIG. 6 shows an exploded view in perspective of the elements forming the frame 12 of the fuel assembly reception and support unit.

Figure 7:
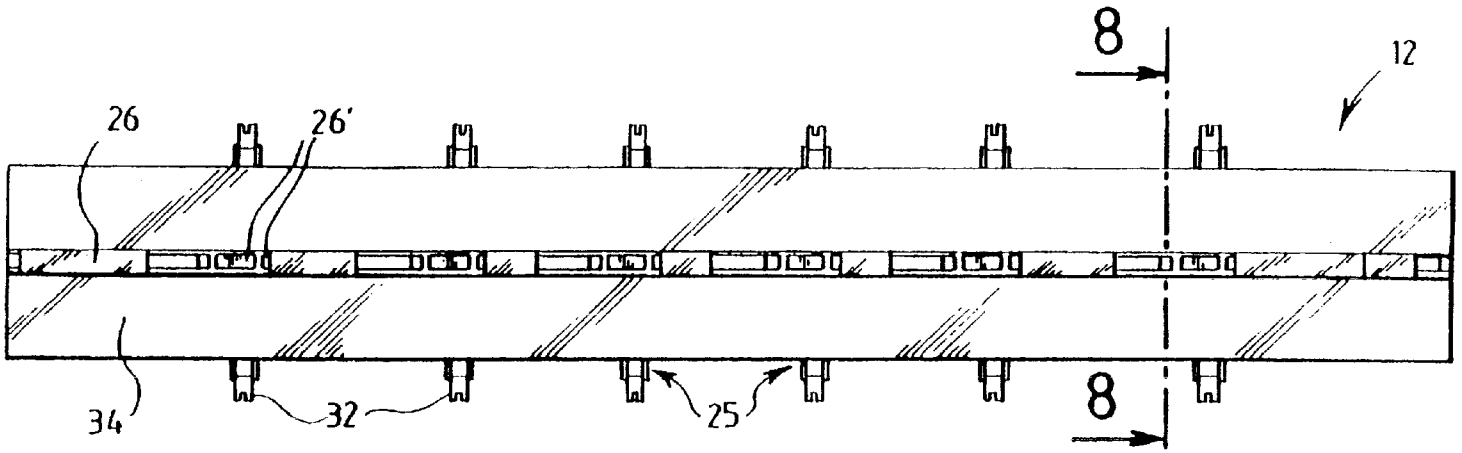
FIG. 7 is a top view of the fuel assembly support frame of the internal structure of the container.
Figure 8:
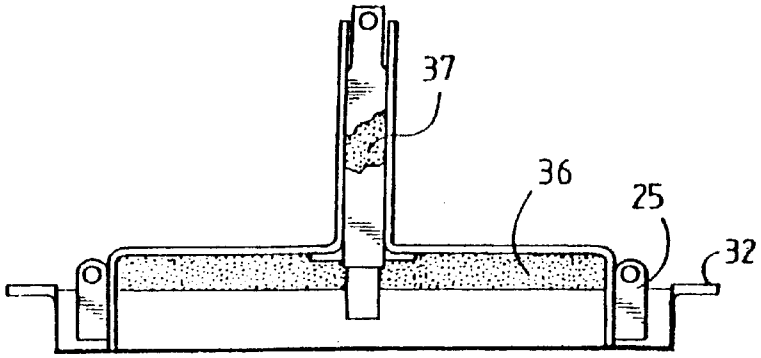
FIG. 8 is a view in transverse section along 8—8 of FIG. 7.

The frame 12 has a baseplate 30 reinforced by welded ribs 29 and by transverse sections 31 at the end of which are fixed articulation axes 25 for the doors 14*a* and 14*b* and lugs 32 for fixing the frame 12 to the lateral sides of the cradle 8, via screws and nuts (FIGS. 7 and 8).

On either side of each of the sections 31, on top of the plate 29, in its median part, columns 33 are fixed perpendicular to the plate 29. To the upper part of the columns 33 are fixed elements 26' for guiding the means of locking the doors of the fuel assembly reception and support unit.

The second element forming the frame 12 is a profiled element in folded metal sheet 34 comprising two elements of metal sheet folded into an L-shape extended towards the bottom by two sills and connected at their upper part by elements which are folded and/or attached forming guide parts 26 for guiding the upper edge of the median wall 12*b* of the frame 12.

On the folded-down lateral edges of the profiled sheet-metal element 34 passages are provided for the articulation axes of the doors and the pads for fixing the frame on the cradle which are fixed to the end of the reinforcing sections 31.

Two T-shaped spacer parts 35*a* and 35*b* are fixed to the end of the plate 29.

The frame 12 is produced by assembling the folded sheet-metal element 34 and the baseplate 29 having reinforcing elements and the columns 33.

The end spacers 35*a* and 35*b* of the baseplate 30 are inserted into the internal profile of the folded sheet-metal element 34. Similarly the six columns 33 are inserted into the vertical part of the internal profile of the folded sheet-metal element 34, between the two vertical branches of the two L-shaped lateral sheet-metal elements.

The guide parts 26' fixed to the end of the columns are inserted between two successive guide parts 26 connecting the two L-shaped folded sheet-metal elements, in the form of the profiled element 34 with a T-shaped transverse cross section.

In the assembled position of the frame 12, the horizontal parts of the sheet-metal elements folded into an L-shape come to rest on the spacers 35 and on the sections 31, in such a way that an empty space is kept between the horizontal parts of the sheet-metal element 34 and the baseplate 29.

As can be seen in FIG. 8, this free space 36 is filled with a neutron-absorbing resin. The resin is a dense resin whose density is between 1.5 and 2.

Similarly, an empty space 37 between the vertical parts of the sheet-metal element 24 is filled with a high density neutron-absorbing resin. The resin and the spacer elements ensure the mechanical integrity of the frame 12.

By assembling the plate 30, its reinforcing elements and the columns 33 with the folded sheet-metal element 34, a double walled, stiff frame 12 is obtained. By filling the empty spaces 36 and 37 of the double wall with a neutron-absorbing resin, a frame whose baseplate 12*a* and the separating median wall 12*b* are capable of absorbing neutron flux produced by fuel assemblies placed in the housings 13*a* and 13*b* of the frame 12 is obtained.

Figure 9:
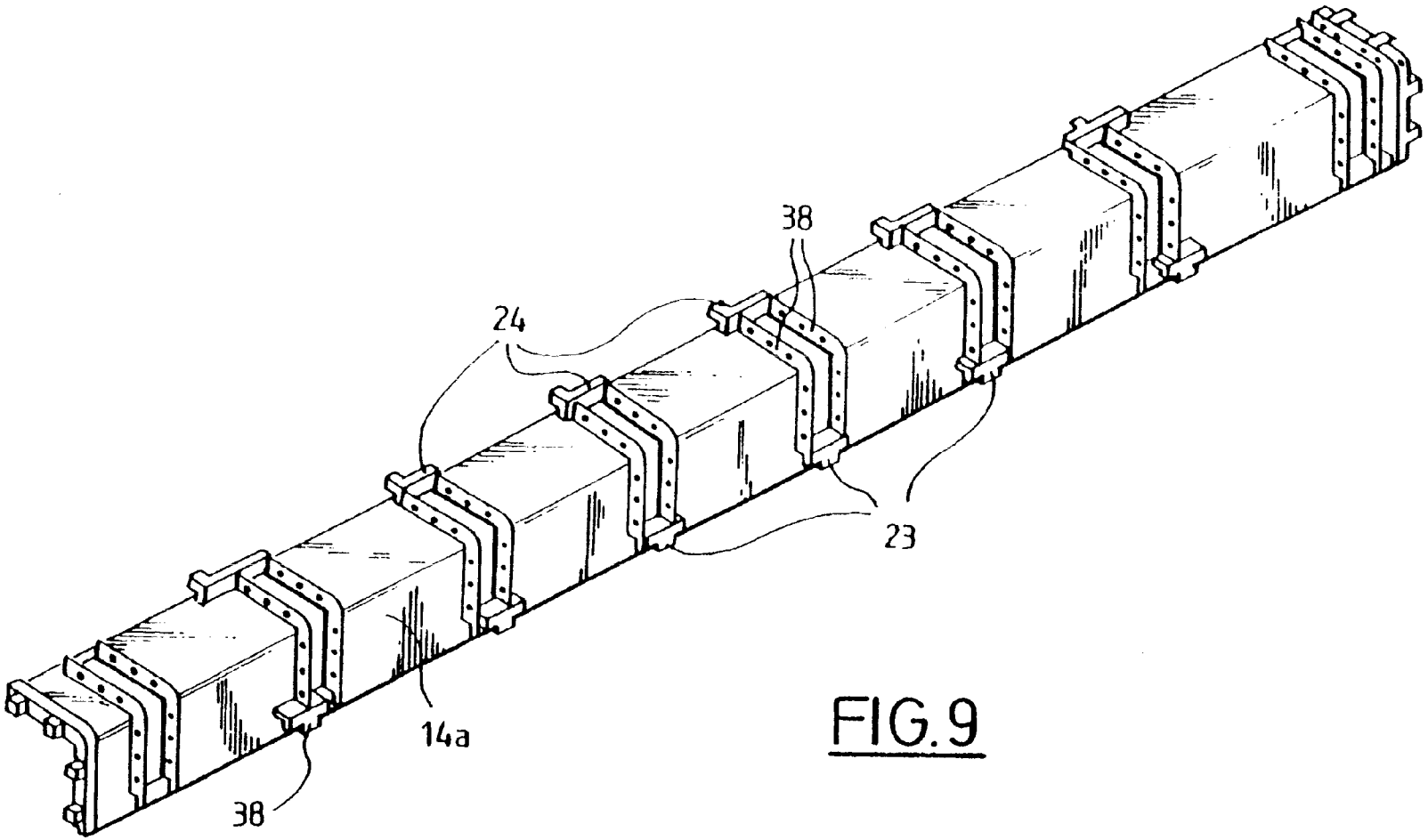
FIG. 9 is a view in perspective of a lateral door of the internal structure of the fuel assembly transport container.

FIG. 9 shows the right hand door 14*a* of the fuel assembly reception and support unit.

The door 14*a* (and likewise the second door 14*b*) is formed by sheet-metal elements folded into an L-shape which are connected to one another at the ends of the branches of the L by extensions of one of the branches, the articulating parts 23 and the locking lugs 24.

Furthermore, between the two metal sheets forming the L-shaped door, spacers 38 are placed at a certain distance from one another over the length of the door 14*a*.

Figure 10:
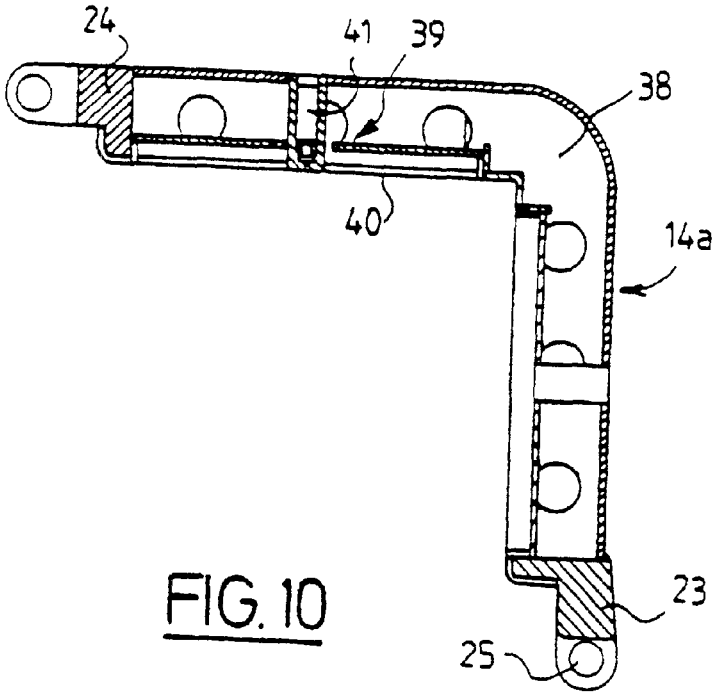
FIG. 10 is a view in transverse section of the lateral door, at the level of devices for lateral holding of a fuel assembly.

Each of the spacers 38 has, as can be seen in FIG. 10, two L-shaped plates spaced out from one another in the longitudinal direction of the door and fixed at their ends to an articulating part 25 and to a locking lug 24, respectively.

A fuel assembly clamping device, placed in the housing defined by the door, is fixed to each of the branches of the L at each spacer 38 between the two L-shaped plates forming the spacer, ensuring the fuel assembly is held in a transverse direction.

As can be seen in FIG. 10, each of the clamping devices 39 has a flat pad 40 which can be manoeuvred from the outside of the door by a screw 41, in order to move it in a direction perpendicular to the branch of the L of the door in which the locking device 39 is mounted.

At each of the spacers 38, the door 14*a* has two clamping devices 39 intended to come into contact with two external faces of a spacer-grid of a fuel assembly positioned in the housing defined by the door 14*a*. In this way, the fuel assembly is clamped into its housing, on two mutually perpendicular sides.

Figure 11:
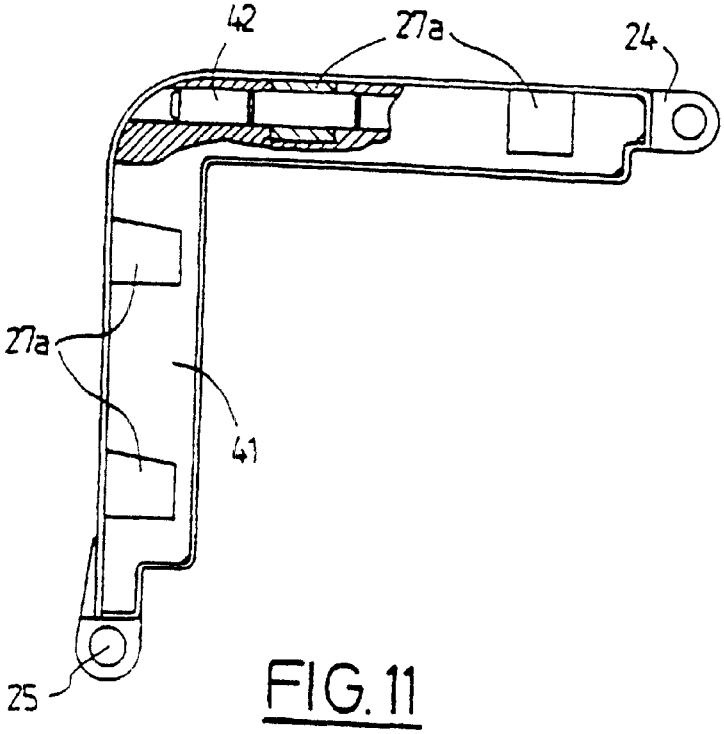
FIG. 11 is an end view, in elevation, with cutaway, of a lateral door of the internal structure of the transport container.

FIG. 11 shows a longitudinal end of the door 14*a* which is closed by an L-shaped plate 41 to which are fixed, projecting towards the outside, pegs 27 for fixing the door 14*a* to the end wall 21. As can be seen on the cutaway part of FIG. 11, a blocking rod 42 is mounted so that it slides in aligned openings in the upper horizontal wall of the door 14*a* and between the pegs 27*a*. Furthermore, the rod 42 is manoeuvrable from the outside of the door 14*a*.

When the door 14*a* is in the closed position and the end plate 20 (or 21) is pulled down to the closed position of the longitudinal ends of the housings of the fuel assembly reception and support unit, the rod 42 can be introduced into aligned openings passing through the external parts of the plate 20 (or 21) between the slots 28, in the transverse direction and the openings between the pegs 27*a* placed in alignment with the openings of the plates 20 (or 21).

In this way the end closure plates 20 and 21 are locked on the end parts of the door 14*a*.

Of course, each of the ends of the door 14*a* having pegs 27*a* and 27'*a* can be locked in an identical fashion.

The same locking rod 42 can lock the second door 14*b* by being introduced into the openings of the plate 20 (or 21) and the pegs 27*b* (or 27'*b*).

The empty space between the two elements of the L-shaped wall of the doors 14*a* and 14*b* is filled with a neutron-absorbing resin, in order to absorb any neutron flux originating from a fuel assembly and directed towards the outside of the fuel assembly reception and support unit. The resin, which has high density (density from 1.5 to 2), and the spacers ensure the mechanical integrity of the doors.

The internal structure of the container according to the invention defines two housings for two fuel assemblies which are completely closed and inside which the fuel assemblies are held laterally and in the axial or longitudinal direction. As the housings are completely closed, if any shock should cause partial destruction of a fuel assembly, parts of the fuel assembly are incapable of escaping from the internal structure which ensures the containment of the fuel assembly. The pieces of the fuel assembly are therefore incapable of spreading inside the external envelope of the container.

Furthermore, the fuel assemblies are separated from each other inside the internal structure of the container, by a neutron-absorbing wall.

The fuel assembly housings defined by the internal structure also have a neutron-absorbing wall closing the housings on the outside, i.e. towards the internal surface of the external envelope of the container.

Improved mechanical protection of the fuel assemblies during their transport inside the container is therefore obtained at the same time as a reduction in the risks of achieving criticality during transport of more than one fuel assembly.

The invention is not limited to the embodiment which has been described.

In this way, the internal structure of the container may have a different shape to that which has been described and may have elements other than a T shaped frame and tilting doors. The shape of the housings in the internal structure of the container depends on the shape of the fuel assemblies being transported. In all cases, the internal structure has walls assembled to each other defining at least one completely closed fuel assembly reception and holding housing.

The invention is applicable to the transport of any nuclear fuel assembly having a right prismatic shape. The container according to the invention can be used not only for the transport of new fuel assemblies but also for the transport of used fuel assemblies having low activity.

What is claimed is:

1. Transport container for nuclear fuel assemblies, of right prismatic shape, comprising:

an external envelope; and an internal structure comprising an external envelope and an internal structure comprising a cradle having a tilting arrangement for mounting the cradle tiltable in the external envelope about an axis of transverse direction and a reception and holding unit resting on the cradle, defining at least one housing for receiving and holding a fuel assembly, and having a frame for supporting at least one fuel assembly comprising at least two walls supporting two lateral faces of a fuel assembly and two pivoting end walls for holding longitudinal end parts of the fuel assembly and at least one door mounted pivoting on the frame between an open position to give access to the fuel assembly housing and a closed position in which the door, the end walls and the support walls of the frame, ensure complete closure of the housing of the fuel assembly and a protection and containment of the fuel assembly, independently of the external envelope.

2. The container according to claim 1, wherein the frame is a frame supporting two fuel assemblies having a T-shaped transverse section, a support base common to two housings of the two assemblies and a separation wall between the housings of the fuel assemblies and the internal structure of the container has two doors having a L-shaped transverse section, each door being articulated to a longitudinal edge of the support base of the frame, in a longitudinal direction of the frame, via a first edge of the door.

3. The container according to claim 2, wherein the doors have pegs projecting towards the outside in the longitudinal direction at their longitudinal ends and in that the end walls closing the longitudinal ends of the housings of the fuel assemblies have, on their external edge, slots into which are introduced the pegs of the doors in the closed position of the doors and of the end plates.

4. The container according to claim 2, wherein the doors have, in their closed position, a second edge pulled down against an end edge of the median separation wall of the frame, the second edges of the doors pulled down on the end edge of the median separation wall of the frame and the end edge of the median part of the frame having locking parts having openings which are aligned in the longitudinal direction of the internal part of the container, for the introduction of a locking rod into the locking parts which have aligned openings.

5. The container according to claim 1, characterized in that the walls of the internal structure of the container around the lateral walls of the at least one housing for a fuel assembly are double walls formed by metal sheets and spacers having a central space filled with a neutron-absorbing resin, so that the spacers and the high density neutron-absorbing resin ensure the mechanical integrity of the walls.

6. The container according to claim 1, wherein at least one of the closure walls of the end faces of the housing of a fuel assembly comprises adjustable means for holding the fuel assembly in the longitudinal direction of the container.

7. The container according to claim 1, wherein the closure walls closing the lateral faces of the housing of the fuel assembly have means for holding the fuel assembly in transverse directions, these means consisting of pads which are movable in transverse directions of the fuel assembly, and manoeuvrable from the outside of the container, so as to come to press against faces of the spacer-grids of the fuel assembly.

8. The container according to claim 1, characterized in that the container comprises, furthermore, between each of the longitudinal ends of the internal structure and each of the longitudinal ends of the external envelope, a shock-absorber formed by a disc of balsa covered by a stainless steel sheet.

* * * * *